United States Patent [19]

Schell et al.

[11] Patent Number: 5,030,794

[45] Date of Patent: Jul. 9, 1991

[54] ACCESSORY RF SHIELDS FOR MULTIPLE-LINE RIBBON CABLES

[75] Inventors: Mark S. Schell, Palatine, Ill.; Warren J. Persak, Mechanicsburg, Pa.

[73] Assignee: RLP Tool Co., Palatine, Ill.

[21] Appl. No.: 479,949

[22] Filed: Feb. 14, 1990

[51] Int. Cl.[5] ..... H01B 7/34; H01B 7/08

[52] U.S. Cl. ..... 174/36; 174/117 F; 174/117 FF

[58] Field of Search ..... 174/36, 117 F, 117 FF, 174/10, DIG. 11, 117 A

[56] References Cited

U.S. PATENT DOCUMENTS

| | | | |
|---|---|---|---|
| 4,281,211 | 7/1981 | Tatum et al. | 174/117 F X |
| 4,409,427 | 10/1983 | Plummer, III | 174/36 |
| 4,477,693 | 10/1984 | Krabec et al. | 174/107 x |
| 4,572,922 | 2/1986 | Plummer, III | 174/36 |
| 4,596,897 | 6/1986 | Gruhn | 174/117 A X |
| 4,734,542 | 3/1988 | Klein | 174/36 |
| 4,737,598 | 4/1988 | O'Connor | 174/36 |
| 4,791,236 | 12/1988 | Klein et al. | 174/DIG. 11 X |

*Primary Examiner*—Morris H. Nimmo
*Attorney, Agent, or Firm*—Charles F. Lind

[57] ABSTRACT

The disclosed accessory RF shield has unitized conductive and insulating barrier sheets, sized to correspond lengthwise to the axial length of a ribbon cable to be shielded and widthwise between opposite side edges to completely encircle the ribbon cable and present overlapped inner and outer side edge layers adapted to be connected together for forming a field connection. The disclosed improved field connection has specific preformed structures, including: (1) that the barrier sheets have a lengthwise prefold therein effective to accurately size the inner side edge layer and allow it during field installation to be positioned accurately over the ribbon cable, whereupon further the outer side edge layer may also then be accurately formed when folded around the ribbon cable; (2) a preformed lengthwise narrow bulged side edge conductive band on the inner side edge layer; (3) a preformed lengthwise narrow bulged side edge insulating band on the outer side edge layer; and (4) a lengthwise strip of adhesive on the outer side edge layer inwardly adjacent the strip of adhesive. When the adhesive strip is pressed against the insulating sheet of the inner side edge layer inwardly adjacent the conductive band, the conductive sheet of the outer side edge layer bows over and contacts the bulged conductive band to define an encircling electrical containment around the ribbon cable, and the insulating band on the inner side edge layer is biased against the insulating sheet on the inner side edge layer to define an encircling insulating containment around the ribbon cable.

12 Claims, 1 Drawing Sheet

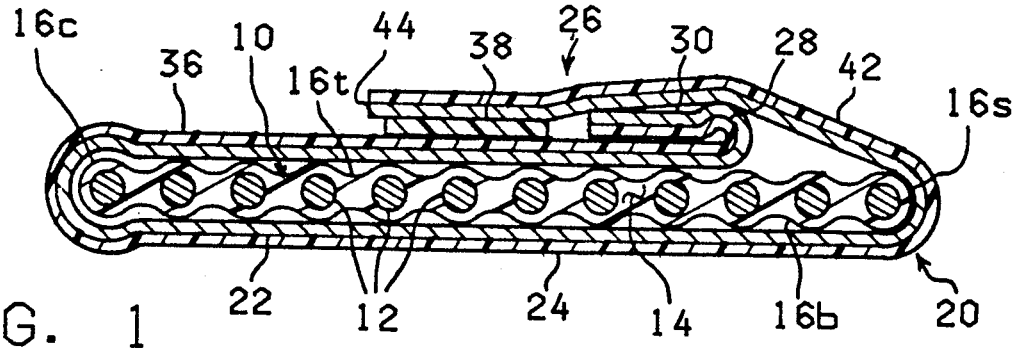
FIG. 1
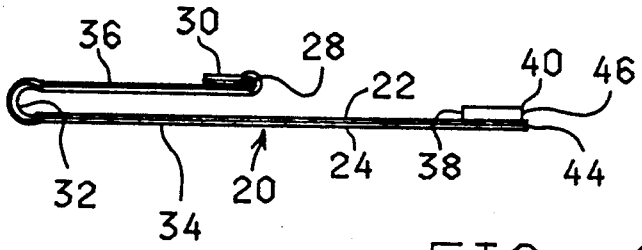
FIG. 2
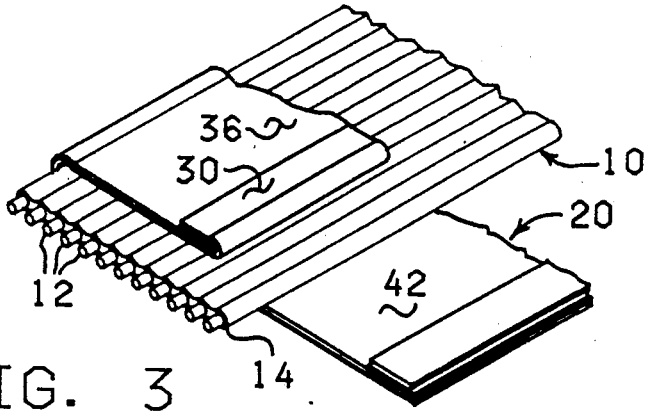
FIG. 3
FIG. 4
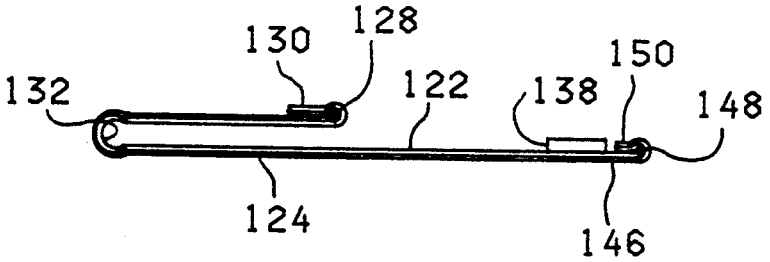
FIG. 5
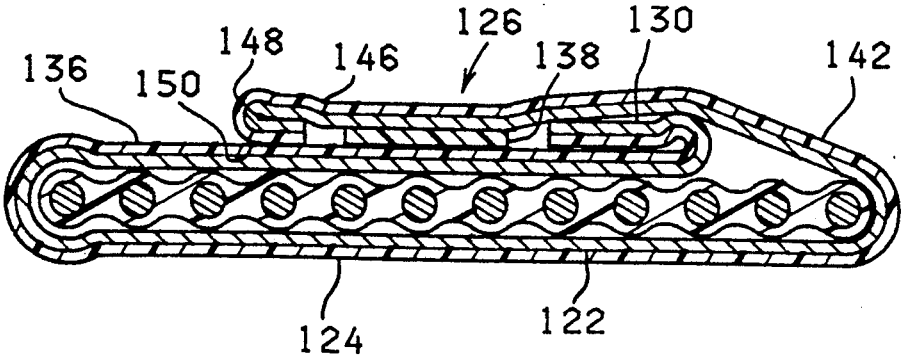

ACCESSORY RF SHIELDS FOR MULTIPLE-LINE RIBBON CABLES

BACKGROUND OF THE INVENTION

Ribbon cables are used extensively in television, computer and related applications to carry many separate low power signals between adjacent physical components. The ribbon cable may have a generally flat configuration, formed by the generally side by side disposition of a plurality of separate electrical conductors or wires each separated from one another and surrounded by electrical insulation. Although the insulation is effective for electrically isolating the signals, it is ineffective in reducing radio frequency emmissions (RFI) and electromagnetic interference (EMI). As these interferences may disrupt the operation of the same or other adjacent components, such as in data transmission, FCC rules may call for shielding the ribbon cable.

An effective barrier for eliminating or reducing these interferences is provided by completely encircling the ribbon cable with a conductive material, such as copper or aluminum. The encircling conductive barrier can be extended axially along the ribbon cable, somewhat as a tube, and possibly even along its entire length including to the end connectors used to electrically and mechanically connect the ribbon cable to the respective physical components.

By way of example, the conductive barrier may be formed as a thin foil sheet, such as a 0.001 inch copper foil or a 0.002 inch aluminum foil. To provides added structural integrity to the conductive foil sheet and/or to minimize the possibility of the conductive sheet accidentally grounding any adjacent component, a thin sheet of MYLAR polyester insulating material or other insulating material may be bonded to or coated on one face of the conductive foil sheet (MYLAR is a trademark of the DuPont (El)deNemours Company). The insulating sheet may also be approximately 0.001 inch thick.

The encircling conductive sheet will typically be connected to a suitable electrical ground. This may be achieved by ground wire(s) connected, by solder, adhesive or the like, to the conductive sheet at spaced locations along the axial length of the ribbon cable. This may also be achieved by a pair of electrically conductive "drain" wires trapped between the conductive and insulating barrier sheets and extended axially along the ribbon cable adjacent the side edges of the ribbon cable.

This type of interference barrier will be referred to as an RF shield in this disclosure.

More specifically, an accessory type RF shield is the type intended to be put on in the field, by a tradesman-type installer; after the ribbon cable has been routed and connected between its adjacent physical components, and without the necessity of disconnecting the ribbon cable end connectors from the respective physical components.

Commercial accessory type RF shields thus may have the conductive and insulating barrier sheets in a generally flat original configuration sufficiently wide, side edge to side edge, to be able to be encircled around a ribbon cable with its opposite side edges overlapped as inner and outer layers. Means are provided on these overlapped side edges (at the inner and outer layers) to allow a field connection to be made for holding the barrier sheets in the encircling position around the ribbon cable.

To install such an RF shield, the conductive barrier sheet may be positioned against the ribbon cable, somewhat centered side edge to side edge, against one flat face of the ribbon cable; whereupon its opposite side edges can be folded around the ribbon cable to overlap as inner and outer layers against the opposite flat face of the ribbon cable, and to then be secured in place as overlapped.

In one commercial accessory type RF shield, an axially elongated adhesive strip is formed on the conductive sheet adjacent the side edge of the outer overlapped layer, and the insulating sheet in this region projects beyond the underlying side edge of the conductive sheet, to define a narrow axially extended insulating lip. As the outer layer is overlapped and pressed against the inner layer, the adhesive strip holds the overlapped layers together in this encircling position around the ribbon cable. The outer layer insulating lip overlies and possibly contacts the insulating layer on the inner layer, and thereby possibly covers the side edge of the outer layer conductive sheet, in an attempt to minimize interference leakage from this field connection.

However, several drawbacks exist by design in this type RF shield that reduce its effectiveness.

For example, the conductive sheet of the inner and outer layers do not ever contact one another providing less than an encircling conductive containment. This inherently allows some resulting interference leakage. Also, the outer layer insulating lip will start out spaced from the underlying inner layer insulating sheet by the combined thicknesses of the conductive sheet and the adhesive strip. The adhesive strip may be approximately 0.001 inch thick, or the same order of thickness of the barrier sheets. The outer layer insulating lip may be manually squeezed by the installer against the inner layer insulating sheet, but it is not mechanically held in this position. Thus, it will remain so positioned only by the material resilience of the insulating lip itself. When the outer layer insulating lip is spaced from the inner layer insulating sheet, the side edge of the outer layer conductive sheet remains exposed for potential interference leakage.

Another major drawback in this type RF shield relates to the manner of installing it in place on the ribbon cable. For example, in one embodiment of this RF shield, the folds of the barrier sheets must be determined solely by the installer; and the ease and accuracy of making the initial fold of the inner layer around the ribbon cable will be based significantly on the installer's skill and care. When shielding a long ribbon cable, the difficultly and potential for error increase dramatically. On the other hand, in another embodiment of this type RF shield, the drain wires are trapped between the barrier sheets almost precisely where the folds are to be made, that is at the opposite side edges of the ribbon cable, so that the barrier sheet folds typically will take place at these drain wires. While this helps folding the barrier sheets accurately, the overall effectiveness of the drain wires comes into question.

Thus, each drain wire is merely trapped between the barrier sheets, held in place by the mechanical bonding of the sheets in the regions immediately adjacent the wire. As the barrier sheets are folded at the drain wires, the inventors speculate that this folding action causes the inward collapse of the conductive foil sheet away from the wires, to reduce the soundness of the physical (and electrical) contact between the conductive sheet and drain wires. This may be the cause of the apparent reduced long-term effectiveness of RF shields of this type in providing a reliable ground.

Another commercial type of RF shield provides for a narrow section of the conductive foil sheet to be removed at the outer layer side edge, leaving a narrow axially extended lip of the insulating sheet; and a strip of adhesive is adhered to the inside face of this outer layer insulating lip. Conversely, a narrow section of the insulating sheet is removed from the inner layer side edge, leaving a narrow lip of the conductive sheet projecting therebeyond. The width sizing of this type RF shield is somewhat criticial to provide that when folded around the ribbon cable, the outer layer adhesive strip must line up over the inner layer insulating sheet and the inner layer conductive lip must underlie the outer layer conductive sheet. With this fit, the opposite edge portions of the conductive sheet should contact one another, to define an encircling conductive containment around the ribbon cable.

However, several drawbacks exist by design in this type RF shield, again reducing its effectiveness.

For example, as the barrier sheets and the adhesive strip may be of comparable thickness, and as the normal separation of the overlapped conductive sheet portions will be the combined thickness of the insulating sheet and the adhesive layer, a natural gap may be expected between the overlapped conductive sheet portions. Again, the manual squeezing action in installing the RF shield may cause these overlapped conductive sheet portions to contact one another; however they are not thereafter mechanically held together and will remain so positioned only by the material resilience of the conductive lip itself. Thus, from the start or after some use and time, the conductive sheet contact portions could gap to provide only a partial encircling conductive containment around the ribbon cable, with its inherent interference leakage.

As noted above, the successful utilization of these commercial RF shields is strongly dependent on the manner of locating them on and folding them around the ribbon cable. As the skill level of the installer is not a predictable or guaranteed factor, having RF shield designs that require extreme installing care and skill may not be favored. The previously mentioned types of commercial RF shields are provided in a flat state, side edge to side edge, so that both intermediate folds must be made around the side edges of the ribbon cable. This has been found to be a tremendous burden on the installer, particularly if the run of the ribbon cable is extended any significant distance such as might be measured in feet and large multiples thereof.

SUMMARY OF THE INVENTION

This invention relates to an improved RF shield for encircling a ribbon cable or the like, and provides for improved ease and accuracy for initially installing it on the ribbon cable and its improved shielding effectiveness including at its field connection against leakage of RFI and EMI interferences.

One object of this invention is to provide an RF shield having a first axially extended intermediate crease loosely preformed therein, suited to allow an installer to position the RF shield rapidly and easily over the ribbon cable to be shielded, and then hold this crease against one side edge of the ribbon cable for accurately making an additional fold around the opposite side edge of the ribbon cable.

Another object of this invention is to provide an RF shield having an improved field connection between overlapped inner and outer side edges of the RF shield, for yielding improved effectiveness of the field connection continuously and axially along its length in preventing or minimizing leakage of RFI and EMI interferences.

BRIEF DESCRIPTION OF THE DRAWINGS

These and other objects of this invention will be more fully appreciated and understood upon reviewing the detailed disclosure to follow, including portions thereof included in the accompanying drawings, wherein:

FIG. 1 is a cross sectional view of a typical ribbon cable and one embodiment of the RF shield to be disclosed herein shown wrapped around and mechanically secured in place on the ribbon cable;

FIG. 2 is an end elevation view of the same RF shield of FIG. 1, except showing it without the ribbon cable, and showing it in its approximate post-manufactured pre-installed shape as it would be received by an installer for ultimate use;

FIG. 3 is a perspective view of the same RF shield and ribbon cable of FIG. 1, except showing the RF shield in an initial phase of installation on the ribbon cable;

FIG. 4 is an end elevation view, similar to FIG. 2, except of a second embodiment of the RF shield; and FIG. 5 is a cross sectional view, similar to FIG. 1, except of the second embodiment of the RF shield shown in FIG. 4.

DETAILED DESCRIPTION OF SPECIFIC EMBODIMENTS OF THE INVENTION

The illustrated ribbon cable 10 can be considered as typical, having a plurality of separate electrical conductors or wires 12 disposed in side-by-side adjacent relationship and separated by insulation 14. The ribbon cable 10 has a generally flat edge to edge configuration, defined by opposing bottom and top faces **16*b* and 16*t* and much narrower opposing edge faces 16*i* and 16*s*. The length of the ribbon cable 10 could vary considerably as needed for a particular installation, between several inches and many feet and possibly even in excess of a hundred feet. Connectors would be provided at its opposite ends of the ribbon cable 10**, to mechanically and electrically connect the ribbon cable between the physically separated electrical components.

Details of the end connectors or electrical components are not shown, as they can be of any conventional construction and do not form any part of the invention to be disclosed herein.

The illustrated RF shield 20 has a unitized construction of separate barrier sheets, including conductive foil sheet 22 and nonconductive or insulating sheet 24, bonded or otherwise secured together along their entire adjacent faces. The unitized sheets 22 and 24 are sufficiently wide to allow them to be wrapped completely around the ribbon cable 10, typically with the conductive sheet 22 on the inside and against the ribbon cable, and define opposite inner and outer side edge layers 36 and 42 respectively suited to overlap and be connected together in forming the field connection (see 26 in FIG. 1).

This invention relates to an improved RF shield 20 and field connection 26, as can be easily detected by improved soundness with respect to its shielding characteristics.

In making the RF shield 20, the sheets 22 and 24 are prefolded about crease 28 to overlap adjacent portions of the insulator sheet, to have them face and lie against one another. This also exposes a narrow band 30 of the conductive sheet 22 extended along one side edge of the RF shield inwardly from the crease 28. The sheets 22 and 24 are also prefolded in the opposite direction about intermediate crease 32, to have adjacent portions of the conductive sheets 22 overlap and face one another. The premade creases 28 and 32 are extended the entire length of the RF shield 20 in a straight and true manner, exactly parallel to each other and to the axial length of the RF shield.

The unitary sheets 22 and 24, extending laterally away from the crease 32, define a main intermediate section 34 and the inner side edge layer 36. The width of the inner side edge layer 36 is selected to correspond to the ribbon cable 10 to be shielded, such as to separate the creases 28 and 32 a distance just less than the width of the ribbon cable 10, such as approximately 50–85% of its width.

A strip 38 of adhesive covered by a peel-off sheet 40 is secured to the conductive sheet 22 of the outer layer 42, a slight distance spaced in from the opposite side edge 44 of the unitized barrier sheets 22 and 24. This leaves a narrow lip 46 of the barrier sheets 22 and 24 projected beyond the adhesive strip 38. The adhesive strip 38 is also extended the entire length of the RF shield 20 in a straight and true manner, exactly parallel to the creases 28 and 32 and to the axial length of the RF shield.

Note that the conductive band 30, defined by the double layers of barrier sheets, creates a slight bulge extended axially of the ribbon cable, and represents the high point on the inner layer above the flat contour of the ribbon cable. The prefold crease 28 may be made about a small or even minimal curvature, to reduce the bulging edge effect of the overlapped sheets 22 and 24 defining the exposed conductive band 30.

By contrast, the intermediate crease 32 need not be sharp but can be about a gradual curvature, corresponding perhaps to half the thickness of the ribbon cable between the opposite faces 16*t* and 16*b*.

The premade crease 32 predefines the inner side edge layer 36 accurately, which allows the RF shield to be positioned easily over its ribbon cable 10 (see FIG. 3). Moreover, the predefined interior of the crease 32 serves as an abutment that can be snugged against the adjacent side edge 16i of the ribbon cable, for accurately positioning the RF shield and the ribbon cable together.

One aspect of this invention is the easy manner of assemblying the RF shield 20 onto the ribbon cable 10. Thus, the installer would position the ribbon cable 10 between the main section 34 and the inner side layer 36, until the ribbon cable 10 became somewhat snugged against the interior of the premade crease 32. With the RF shield 20 so positioned, the installer may then manually fold the unitized sheets 22 and 24 upwardly from the main intermediate section 34 and around the opposite edge face 16*s* of the ribbon cable 10. The outer side layer 42 can then overlap the inner layer 36.

With the adhesive cover 40 removed, the exposed adhesive strip 38 may then be pressed against the underlying insulator layer 24 of the inner layer 36 to complete the field connection 26. When the RF shield 20 is properly sized and assemblied onto the ribbon cable 10, the strip of adhesive 38 on the outer layer 42 will engage the opposite inner layer 36 just beyond the narrow conductive band 30.

Another aspect of this invention is the reliable cooperation the barrier sheets 22 and 24 have with one another after the field connection has been completed. As the bulged conductive band 30 is immediately adjacent the location where the strip of adhesive 38 cooperates with the inner layer 36, and as the thickness of the strip of adhesive is less than this bulge, the outer layer must be bowed over this inner layer budge. The outer layer conductive foil sheet 22 thus overlaps and contacts the inner layer conductive band 30 with a mechanical force to provide a sound electrical connection between the lapped conductive sheet and band. This provides an encircling conductive containment around the ribbon cable 10, to yield an effective RF shield around the ribbon cable.

Another embodiment of the invention is illustrated in FIGS. 4 and 5, and adds to the disclosure of FIGS. 1–3. However, like components will use different identifying numbers (the same number plus one hundred). Thus, end lip 146 of the barrier sheets is elongated somewhat and is precreased at 148 to bring the adjacent portions of the conductive foil 122 against one another. This also defines a narrow band 150 of the insulating sheet 124 immediately adjacent the strip of adhesive 138. This crease 148 can be of a tight curvature.

Note that the insulating band 150, defined by the double layers of barrier sheets, creates a slight bulge extended axially of the ribbon cable. Upon the field connection 126 being established, where the adhesive 138 is snugged against the insulator layer 124 of the inner layer 136 and the conductive sheet 122 overlaps the conductive band 130, the insulating band 150 will be mechanically held against the underlying insulating sheet 124 of the inner layer and only the end edge of insulating band 150 of the outer layer 142 will be exposed.

The encircling insulation containment of FIGS. 4 and 5 around the conductive containment already established by the previously identified structures of the field connection 26 of FIGS. 1–3, truly enhanced RF shield sealing capabilities. The disclosed structures mechanically provide improved soundness of these conductive and insulating containments, at the engaged conductive band 30 (or 130) and the insulating band 150, extended continuously along the desired length of the ribbon cable, to minimize gaps along the ribbon cable through which interference leakage can escape.

A specific reminder of the small relative size of the components used in this invention may be in order. As noted, the conductive barrier may be formed as a thin foil sheet, such as a 0.001 inch copper foil or a 0.002 inch aluminum foil. The insulating sheet may also be approximately 0.001 inch thick, and possibly of MYLAR polyester film. The adhesive strip may too be approximately 0.001 inch thick. The conductive band 30 may be between 0.1 and 0.5 inch wide, as may the adhesive strip. The drawings have thus been greatly enlarged to illustrate the construtions better. These RF shield sizes may be suited for use with a typical ribbon cable being possibly between 0.1 and 0.3 inch thick (between faces 16*t* and 16*b*) and possibly between 1.0 and 5.0 inch wide.

Ground cables (not shown) each having an adhesive pad and a somewhat flexible wire or tape conductor extended off of the pad can be used where needed along the length of the RF shield. Each adhesive pad would be stuck to the conductive foil sheet where needed before the RF shield is positioned over the ribbon cable, and the flexible conductor would be fed to the exterior of the shield for connection then to a suitable ground, either through the field connection or via the exposed end of the RF shield.

Of interest also, the disclosed RF shields can be made very economically, and after being made but before being installed over or onto its ribbon cable will be very durable for easy handling. Thus, a unitized barrier sheet can be made by laminating or bonding the conductive and insultating barrier sheets together, but of a width several or even many times that needed for forming the width of one shield. The unitized barrier sheet can then be slit lenghtwise at one or several locations to define several shield bodies, each precut to the exact widths needed (they need not even be the same width), and the cut edges of the unitized barrier sheet will have both the conductive and insultating barrier sheets bonded together (for increased durability), with no exposed lips of either barrier sheet by itself. Thereafter, each precut shield body can then be prefolded as needed, along creases 28 and 32 (or 128 and 132, and 148).

This manner of mass making the shield bodies cannot be done when drain wires are trapped between the conductive and insultating barrier sheets, and/or when a single sheet thickness exposed lip of either the conductive and insultating barrier sheet must be defined along the side edge of the shield; but more commonly, each such shield body must be laminated and/or made individually. Moreover, exposed single sheet thickness lip of either the conductive and insultating barrier sheet along the side edge of the prior shield body, greatly reduce the overal strength and durability of the RF shield at such single thickness lip.

While only specific embodiments of the invention have been disclosed, it would be appreciated that variations may be made therefrom without departing from the basic inventive concept. Accordingly, the invention is to be limited by the following claims.

What we claim as our invention is:

1. An accessory RF shield, operable to be field installed around a ribbon cable having opposed major faces and first and second side faces, comprising the combination of a unitized barrier formed of a conductive sheet and an insulating sheet, the sheets overlapping substantially coextensively and being secured flush together;

said unitized barrier corresponding lengthwise to the axial length of the ribbon cable to be shielded and having opposite side edges;

said unitized barrier being folded about an intermediate lengthwise prefold, effective to define an inner side edge layer having as a part thereof one of the side edges and an overlapping main section having as a part thereof the other of the side edges, and the conductive sheet on each being adjacent and facing one another;

said inner side edge layer being narrower than the ribbon cable to be shielded, said main section being wider than the ribbon cable to be shielded, and the combined widths of said inner side edge layer and main section being sufficient to allow the unitized barrier to completely encircle the ribbon cable to be shielded;

the unitized barrier also being folded about a lengthwise prefold near the other side edge, effective to define overlapped portions with the conductive sheet on each being closely adjacent and facing one another and to define a narrow bulged band of insulating sheet extended inwardly along the other side edge; and a strip of adhesive on the conductive sheet inwardly of and immediately adjacent the narrow buldged insulating band and near the other side edge;

whereupon, to field install the RF shield, the folded unitized barrier is slipped over the ribbon cable to be shielded with the conductive sheet of the inner side edge layer and main section snugged against the major faces of the ribbon cable and with the intermediate prefold snugged against the first side face of the ribbon cable, and whereupon the main section of the unitized barrier extended beyond the second side face of the ribbon cable to be shielded is then folded around said second side face to define an outer side edge layer that can overlap the inner side edge layer and the strip of adhesive is pressed against the inner side edge layer, to provide that the narrow insulating band overlies and is mechanically biased against the insulating sheet on the inner side edge layer defining an encircling electrical insulation containment around the ribbon cable to be shielded when the inner and outer side layers are secured together.

2. An accessory RF shield, operable to be field installed around a ribbon cable having opposed major faces and first and second side faces, comprising the combination of a unitized barrier formed of a conductive sheet and an insulating sheet, the sheets overlapping substantially coextensively and being secured flush together;

said unitized barrier corresponding lengthwise to the axial length of the ribbon cable to be shielded and having opposite side edges;

said unitized barrier being folded about an intermediate lengthwise prefold, effective to define an inner side edge layer having as a part thereof one of the side edges and an overlapping main section having as a part thereof the other of the side edges, and the conductive sheet on each being adjacent and facing one another;

said inner side edge layer being narrower than the ribbon cable to be shielded, said main section being wider than the ribbon cable to be shielded, and the combined widths of said inner side edge layer and main section being sufficient to allow the unitized barrier to completely encircle the ribbon cable to be shielded;

the unitized barrier also being folded about a first lengthwise prefold near the one side edge, effective to define overlapped portions with the insulating sheet on each being closely adjacent and facing one another and to define a narrow bulged band of the conductive sheet extended along and immediately adjacent said one side edge; and the unitized barrier also being folded about a second lengthwise prefold near the other side edge, effective to define overlapped portions with the conductive sheet on each being closely adjacent and facing one another and to define a narrow bulged band of insulating sheet extended inwardly along the other side edge; and a strip of adhesive on the conductive sheet inwardly of and immediately adjacent the narrow bulged insulating band and near the other side edge;

whereupon, to field install the RF shield, the folded unitized barrier is slipped over the ribbon cable to be shielded with the conductive sheet of the inner side edge layer and main section snugged against the major faces of the ribbon cable and with the intermediate lengthwise prefold snugged against the first side face of the ribbon cable, and whereupon the main section of the unitized barrier extended beyond the second side face of the ribbon cable to be shielded is then folded around said second side face to define an outer side edge layer that overlaps the inner side edge layer and the strip of adhesive is pressed against the inner side edge layer to secure the inner and outer side layers together, to provide that the conductive sheet on the outer side edge layer immediately inwardly adjacent the strip of adhesive overlies the narrow bulged conductive band and is thereby mechanically bowed and biased thereagainst for defining an encircling electrical shield containment around the ribbon cable to be shielded and to provide that the narrow bulged insulating band overlies and is mechanically biased against the insulating sheet on the inner side edge layer for defining an encircling to be shielded, all when the inner and outer side layers are secured together.

3. An accessory RF shield according to claim 2, further wherein the lengthwise prefolds and adhesive strip are straight and parallel to one another and extend the axial length of the RF shield.

4. An accessory RF shield according to claim 3, further wherein the intermediate lengthwise prefold and first lengthwise prefold are spaced apart a distance approximately 50–85% of the width of the ribbon cable to be shielded.

5. An accessory RF shield according to claim 3, further including a peel-off sheet for covering the adhesive strip until it is to be used.

6. An accessory RF shield, operable to be field installed around a ribbon cable having opposed major faces and first and second side faces, comprising the combination of a unitized barrier formed of a conductive sheet and an insulating sheet, the sheets overlapping substantially coextensively and being secured finish together;

said unitized barrier corresponding lengthwise to the axial length of the ribbon cable to be shielded and having opposite side edges;

said unitized barrier being folded about an intermediate lengthwise prefold, effective to define an inner side edge layer having as a part thereof one of the side edges and a main section having as a part thereof the other of the side edges, and the conductive sheet on each being adjacent and facing one another;

said inner side edge layer being narrower than the ribbon cable to be shielded, said main section being wider than the ribbon cable to be shielded, and the combined widths of said inner side edge layer and main section being sufficient to allow the unitized barrier to completely encircle the ribbon cable to be shielded;

a narrow conductive band extended along said one side edge and adjacent said insulating sheet; and a strip of adhesive located on the conductive sheet near the other side edge; and whereupon, to field install the RF shield, the folded unitized barrier is slipped over the ribbon cable to be shielded with the conductive sheet of the inner side edge layer and main section snugged against the major faces of the ribbon cable and the intermediate prefold snugged against the first side face of the ribbon cable, and whereupon the main section of the unitized barrier extended beyond the second side face of the ribbon cable to be shielded is then folded around said second side face to define an outer side edge layer that overlaps the inner side edge layer and the strip of adhesive is pressed against the inner side edge layer to secure the inner and outer side layers together, to then provide that the conductive sheet on the outer side edge layer overlies the narrow conductive band and the strip of adhesive cooperates with the inner side edge layer inwardly adjacent the conductive band, for defining an encircling electrical shielding containment around the ribbon cable to be shielded.

7. An accessory RF shield according to claim 6, further wherein the narrow conductive band is formed by backfolding the unitized barrier to form lengthwise prefold and define overlapped portions with the insulating sheet facing and is bulged and extended immediately adjacent said one side edge, to provide that the outer side edge layer must be mechanically bowed over the bulged conductive band when the inner and outer side edge layers are secured together along the strip of adhesive.

8. An accessory RF shield according to claim 6, further including a narrow insulating band common with the insulating sheet extended on the outer side edge layer along said other side edge adjacent said conductive sheet and outwardly of said strip of adhesive, operable upon the strip of adhesive being pressed against the inner side edge layer to overlie against the insulating sheet of the inner side layer for defining an encircling insulation containments around the ribbon cable to be shielded.

9. An accessory RF shield according to claim 8, further wherein the intermediate lengthwise prefold is about a gradual curvature, corresponding approximately to half the thickness of the ribbon cable between the major faces thereof.

10. An accessory RF shield according to claim 8, further wherein the narrow insulating band is immediately adjacent and outwardly of said strip of adhesive.

11. An accessory RF shield according to claim 10, further wherein the narrow insulating band is bulged, to provide that it is mechanically biased against the insulating sheet of the inner side layer when the inner and outer side edge layers are secured together along the strip of adhesive for defining an effective encircling insulation containments around the ribbon cable to be shielded.

12. An accessory RF shield according to claim 11, further wherein the narrow conductive band is bulged, to provide that the overlying outer side edge layer must be mechanically bowed over it when the inner and outer side edge layers are secured together along the strip of adhesive.

* * * * *